US012134857B2

(12) United States Patent
Nishigawa et al.

(10) Patent No.: US 12,134,857 B2
(45) Date of Patent: Nov. 5, 2024

(54) ELASTIC FIBER TREATING AGENT AND ELASTIC FIBERS

(71) Applicant: TAKEMOTO YUSHI KABUSHIKI KAISHA, Aichi-ken (JP)

(72) Inventors: Takeshi Nishigawa, Gamagori (JP); Kohei Oda, Gamagori (JP); Keiichiro Oshima, Gamagori (JP)

(73) Assignee: TAKEMOTO YUSHI KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 18/027,352

(22) PCT Filed: Sep. 17, 2021

(86) PCT No.: PCT/JP2021/034219
§ 371 (c)(1),
(2) Date: Jul. 10, 2023

(87) PCT Pub. No.: WO2022/065210
PCT Pub. Date: Mar. 31, 2022

(65) Prior Publication Data

US 2023/0349096 A1 Nov. 2, 2023

(30) Foreign Application Priority Data

Sep. 23, 2020 (JP) ..... 2020-158555

(51) Int. Cl.

| | |
|---|---|
| ***D06M 13/00*** | (2006.01) |
| ***D06M 13/02*** | (2006.01) |
| ***D06M 13/144*** | (2006.01) |
| ***D06M 13/203*** | (2006.01) |
| ***D06M 13/224*** | (2006.01) |
| ***D06M 13/292*** | (2006.01) |
| ***D06M 15/643*** | (2006.01) |
| *D06M 101/38* | (2006.01) |

(52) U.S. Cl.
CPC ..... *D06M 13/203* (2013.01); *D06M 13/02* (2013.01); *D06M 13/144* (2013.01); *D06M 13/224* (2013.01); *D06M 13/292* (2013.01); *D06M 15/643* (2013.01); *D06M 2101/38* (2013.01); *D06M 2200/40* (2013.01)

(58) Field of Classification Search
CPC .. D06M 13/203; D06M 13/02; D06M 13/144; D06M 13/224; D06M 13/292; D06M 15/643; D06M 2101/38; D06M 2200/40
USPC ..... 106/243
See application file for complete search history.

(56) References Cited

FOREIGN PATENT DOCUMENTS

| | | | | | |
|---|---|---|---|---|---|
| CN | 106930104 | A | | 7/2017 | |
| CN | 108893978 | A | * | 11/2018 | ..... D06M 13/02 |
| JP | S60-67442 | A | | 4/1985 | |
| JP | 2004-060135 | A | | 2/2004 | |
| JP | 2017-110319 | A | | 6/2017 | |
| JP | 6614628 | B1 | * | 12/2019 | ..... D06M 13/02 |
| JP | 2020-020051 | A | | 2/2020 | |
| WO | WO 2011/105386 | A1 | | 9/2011 | |

OTHER PUBLICATIONS

International Search Report and Written Opinion dated Oct. 12, 2021, in connection with International Application No. PCT/JP2021/034219.

* cited by examiner

*Primary Examiner* — James E McDonough
(74) *Attorney, Agent, or Firm* — Wolf, Greenfield & Sacks, P.C.

(57) ABSTRACT

Disclosed is an elastic fiber treatment agent that contains a silicone oil as a smoothing agent (A), an unsaturated fatty acid metal salt (B), and a higher alcohol (D), and optionally an organic phosphate ester compound (C). An alcohol forming the higher alcohol (D) is a Guerbet alcohol.

7 Claims, No Drawings

ELASTIC FIBER TREATING AGENT AND ELASTIC FIBERS

CROSS REFERENCE TO RELATED APPLICATIONS

This Application is a national stage filing under 35 U.S.C. 371 of International Patent Application Serial No PCT/JP2021/034219, filed Sep. 17, 2021, which claims priority to Japanese application number 2020-158555 filed, Sep. 23, 2020. The entire contents of these applications are incorporated herein by reference in their entirety.

TECHNICAL FIELD

The present invention relates to an elastic fiber treatment agent that contains an unsaturated fatty acid metal salt and to an elastic fiber to which the elastic fiber treatment agent is adhered.

BACKGROUND ART

Elastic fibers, such as polyurethane elastic fibers, are strong in stickiness between the fibers in comparison to other synthetic fibers. Therefore, there is a problem in that when after elastic fibers are spun and wound into a package, the fibers are drawn out from the package to be subject to a processing step, it is difficult to unwind the fibers stably from the package. Thus, an elastic fiber treatment agent that contains a smoothing agent such as a hydrocarbon oil may be used to improve the smoothness of the elastic fibers.

An elastic fiber treatment agent as disclosed in Patent Document 1 is previously known. Patent Document 1 discloses an elastic fiber treatment agent that contains a base component such as a mineral oil, an alkylene oxide (1 to 15 mol) adduct of an alcohol having a hydrocarbon group with 1 to 30 carbon atoms, and a carboxylic acid having a hydrocarbon group with 1 to 30 carbon atoms, a metal salt thereof, or an amine salt thereof.

CITATION LIST

Patent Literature

Patent Document 1: Japanese Laid-Open Patent Publication No. 2004-60135

SUMMARY OF INVENTION

Technical Problem

However, there has been a demand for further improvement in shape properties when an elastic fiber to which the elastic fiber treatment agent is applied is wound into a predetermined shape.

Solution To Problem

As a result of performing research toward solving the above problem, the inventors of the present application have found that an elastic fiber treatment agent in which a specific smoothing agent (A) and an unsaturated fatty acid metal salt (B) are blended is suitable.

In order to solve the above problem and in accordance with one aspect of the present invention, an elastic fiber treatment agent is characterized by containing at least one smoothing agent (A) selected from the group consisting of a mineral oil, a silicone oil, and an ester oil and an unsaturated fatty acid metal salt (B).

In the elastic fiber treatment agent, it is preferable that the unsaturated fatty acid metal salt (B) is an unsaturated fatty acid alkaline earth metal salt.

In the elastic fiber treatment agent, it is preferable that the unsaturated fatty acid metal salt (B) has 12 to 24 carbon atoms.

It is preferable that if the sum of the content ratios of the smoothing agent (A) and the unsaturated fatty acid metal salt (B) in the elastic fiber treatment agent is taken as 100 parts by mass, the content ratio of the unsaturated fatty acid metal salt (B) in the elastic fiber treatment agent is 0.1 to 10 parts by mass.

It is preferable that the elastic fiber treatment agent further contains an organic phosphate ester compound (C).

In the elastic fiber treatment agent, it is preferable that the organic phosphate ester compound (C) is an organic phosphate ester salt.

It is preferable that if the sum of the content ratios of the smoothing agent (A), the unsaturated fatty acid metal salt (B), and the organic phosphate ester compound (C) in the elastic fiber treatment agent is taken as 100 parts by mass, the content ratio of the unsaturated fatty acid metal salt (B) in the elastic fiber treatment agent is 0.1 to 10 parts by mass.

It is preferable that the elastic fiber treatment agent further contains a higher alcohol (D).

It is preferable that the elastic fiber treatment agent further contains a higher alcohol (D) and that if the sum of the content ratios of the smoothing agent (A), the unsaturated fatty acid metal salt (B), and the higher alcohol (D) in the elastic fiber treatment agent is taken as 100 parts by mass, the content ratio of the unsaturated fatty acid metal salt (B) in the elastic fiber treatment agent is 0.1 to 10 parts by mass.

It is preferable that the elastic fiber treatment agent further contains a higher alcohol (D) and that if the sum of the content ratios of the smoothing agent (A), the unsaturated fatty acid metal salt (B), the organic phosphate ester compound (C), and the higher alcohol (D) in the elastic fiber treatment agent is taken as 100 parts by mass, the content ratio of the unsaturated fatty acid metal salt (B) in the elastic fiber treatment agent is 0.1 to 10 parts by mass.

In order to solve the above problem and in accordance with another aspect of the present invention, an elastic fiber is characterized in that the elastic fiber treatment agent is adhered thereto.

Advantageous Effects of Invention

The present invention succeeds in improving shape properties of an elastic fiber.

DESCRIPTION OF EMBODIMENTS

First Embodiment

A first embodiment in which an elastic fiber treatment agent (also referred to hereinafter as treatment agent) of the present invention is embodied will now be described. The treatment agent of the present embodiment contains a smoothing agent (A) and an unsaturated fatty acid metal salt (B).

The smoothing agent (A) is blended in the treatment agent as a base component and plays a role of imparting smoothness to an elastic fiber. Examples of the smoothing agent (A) include a mineral oil, a silicone oil, and an ester oil.

Examples of the mineral oil include aromatic hydrocarbons, paraffinic hydrocarbons, and naphthenic hydrocarbons. More specific examples of the mineral oil include spindle oil and liquid paraffin. As the mineral oil, a commercially available product defined by viscosity or the like may be appropriately used.

Specific examples of the silicone oil include dimethyl silicone, phenyl-modified silicone, amino-modified silicone, amide-modified silicone, polyether-modified silicone, aminopolyether-modified silicone, alkyl-modified silicone, alkylaralkyl-modified silicone, alkylpolyether-modified silicone, ester-modified silicone, epoxy-modified silicone, carbinol-modified silicone, mercapto-modified silicone, and polyoxyalkylene-modified silicone. As the silicone oil, a commercially available product defined by kinematic viscosity or the like may be appropriately used. The kinematic viscosity of the silicone oil is appropriately set, but the silicone oil preferably has a kinematic viscosity at 25° C. of 2 to 100 cst ($mm^2/s$). The kinematic viscosity at 25° C. of the silicone oil is measured in accordance with JIS Z8803.

The ester oil is not particularly limited, and examples thereof include ester oils produced from fatty acids and alcohols. The ester oil is, for example, an ester oil produced from a fatty acid having an odd or even number of hydrocarbon groups and an alcohol, which will be described later.

The fatty acid, which is a raw material for the ester oil, is not particularly limited in terms of, for example, the number of carbon atoms, presence or absence of branching, or valence, and may be, for example, a higher fatty acid, a fatty acid having a cyclo ring, or a fatty acid having an aromatic ring. The alcohol, which is a raw material for the ester oil, is not particularly limited in terms of, for example, the number of carbon atoms, presence or absence of branchinu, or valence, and may be, for example, a higher alcohol, an alcohol having a cyclo ring, or an alcohol having an aromatic ring.

Specific examples of the ester oil include (1) ester compounds of an aliphatic monoalcohol and an aliphatic monocarboxylic acid, such as octyl palmitate, oleyl laurate, oleyl oleate, isotridecyl stearate, and isotetracosyl oleate, (2) ester compounds of an aliphatic polyhydric alcohol and an aliphatic monocarboxylic acid, such as 1,6-hexanediol didecanate, glycerin trioleate, trimethylolpropane trilaurate, and pentaerythritol tetraoctanate, (3) ester compounds of an aliphatic monoalcohol and an aliphatic polyhydric carboxylic acid, such as dioleyl azelate, dioleyl thiodipropionate, diisocetyl thiodipropionate, and diisostearyl thiodipropionate, (4) ester compounds of an aromatic monoalcohol and an aliphatic monocarboxylic acid, such as benzyl oleate and benzyl laurate, (5) complete ester compounds of an aromatic polyhydric alcohol and an aliphatic monocarboxylic acid, such as bisphenol A dilaurate, (6) complete ester compounds of an aliphatic monoalcohol and an aromatic polycarboxylic acid, such as bis2-ethylhexyl phthalate, diisostearyl isophthalate, and trioctyl trimellitate, and (7) natural fats and oils, such as coconut oil, rapeseed oil, sunflower oil, soybean oil, castor oil, sesame oil, fish oil, and beef tallow.

As the smoothing agent (A), one smoothing agent may be used alone, or two or more smoothing agents may be used in combination.

In the present embodiment, a smoothing agent other than the above ones may be used in combination as long as the effects of the present invention are not impaired. As the smoothing agent other than the above ones, a known smoothing agent may be appropriately used. Examples of the smoothing agent other than the above ones include polyolefins.

As the polyolefin, a poly-α-olefin used as a smoothing component is used. Specific examples of the polyolefin include poly-α-olefins obtained by polymerizing, for example, 1-butene, 1-hexene, or 1-decene. As the poly-α-olefin, a commercially available product may be appropriately used.

The treatment agent of the present embodiment contains the unsaturated fatty acid metal salt (B), and thus can improve, particularly, the shape properties of an elastic fiber. Specific examples of the unsaturated fatty acid forming the unsaturated fatty acid metal salt (B) include myristoleic acid, palmitoleic acid, oleic acid, vaccenic acid, eicosenoic acid, erucic acid, nervonic acid, linoleic acid, α-linolenic acid, γ-linolenic acid, and arachidonic acid. Among them, an unsaturated fatty acid with 12 to 24 carbon atoms is preferable. With such a configuration, the effects of the present invention can be further improved.

Examples of the metal salt include an alkali metal salt and an alkaline earth metal salt. Specific examples of alkali metals forming the alkali metal salt include sodium, potassium, and lithium. Examples of alkaline earth metals forming the alkaline earth metal salt include metals corresponding to Group 2 elements, such as calcium, magnesium, beryllium, strontium, and barium. Among these metal salts, alkaline earth metal salts are preferable from the viewpoint of excellent smoothness.

As the unsaturated fatty acid metal salt (B), one unsaturated fatty acid metal salt may be used alone, or two or more unsaturated fatty acid metal salts may be used in combination.

If the sum of the content ratios of the smoothing agent (A) and the unsaturated fatty acid metal salt (B) in the treatment agent is taken as 100 parts by mass, the content ratio of the unsaturated fatty acid metal salt (B) in the treatment agent is preferably 0.1 to 10 parts by mass. The content ratio is defined in such a range, so that the effects of the present invention can be further improved.

If the sum of the content ratios of the smoothing agent (A) and the unsaturated fatty acid metal salt (B) in the treatment agent is taken as 100 parts by mass, the content ratio of the smoothing agent (A) and the content ratio of the unsaturated fatty acid metal salt (B) in the treatment agent are preferably 93 to 99.8 parts by mass and 0.2 to 7 parts by mass, respectively. The content ratios are defined in such ranges, so that the effects of the present invention can be further improved.

The treatment agent of the present embodiment may further contain an organic phosphate ester compound (C). When the treatment agent contains the organic phosphate ester compound (C), the shape properties of an elastic fiber can be further improved. Examples of the organic phosphate ester compound (C) to be used in the treatment agent of the present embodiment include a phosphate ester compound having an alkyl group in the molecule, and a phosphate ester compound having a polyoxyalkylene group composed of an oxyalkylene group and an alkyl group in the molecule. The organic phosphate ester compound may be an organic phosphate ester compound that has not been subjected to neutralization treatment, or may be an organic phosphate ester salt that has been subjected to neutralization treatment. Among them, an organic phosphate ester salt is preferable from the viewpoint of further improving a cob webbing prevention property, which will be described later.

The alkyl group forming the organic phosphate ester compound (C) is not particularly limited, and examples thereof include a linear alkyl group and a branched alkyl group. A branching position in the branched alkyl group is not particularly limited, and may be, for example, an alkyl group in which the α-position is branched, or an alkyl group in which the β-position is branched.

The number of carbon atoms in the alkyl group is not particularly limited, but is preferably 1 to 32, and more preferably 8 to 22. Specific examples of the alkyl group include a methyl group, an ethyl group, a propyl group, a butyl group, a pentyl group, a hexyl group, a heptyl group, an octyl group, a decyl group, an undecyl group, a dodecyl group, a tridecyl group, a tetradecyl group, a pentadecyl group, a hexadecyl group, a heptadecyl group, an octadecyl group, an icosyl group, an isopropyl group, an isobutyl group, an isopentyl group, an isohexyl group, an isoheptyl group, an isooctyl group, an isodecyl group, an isoundecyl group, an isododecyl group, an isotridecyl group, an isotetradecyl group, an isopentadecyl group, an isohexadecyl group, an isoheptadecyl group, an isooctadecyl group, and an isoicosyl group.

The phosphoric acid forming the organic phosphate ester compound (C) is not particularly limited, and may be orthophosphoric acid or polyphosphoric acid, such as diphosphoric acid.

When an organic phosphate ester salt is used as the organic phosphate ester compound (C), examples of the salt include a phosphate ester amine salt and a phosphate ester metal salt.

Examples of the metal salt include an alkali metal salt and an alkaline earth metal salt. Specific examples of alkali metals forming the alkali metal salt include sodium, potassium, and lithium. Examples of alkaline earth metals forming the alkaline earth metal salt include metals corresponding to Group 2 elements, such as calcium, magnesium, beryllium, strontium, and barium.

An amine forming the amine salt may be any of a primary amine, a secondary amine, and a tertiary amine. Specific examples of the amine forming the amine salt include (1) aliphatic amines, such as methylamine, dimethylamine, trimethylamine, ethylamine, diethylamine, triethylamine, N—N-diisopropylethylamine, butylamine, dibutylamine, 2-methylbutylamine, tributylamine, octylamine, and dimethyllaurylamine, (2) aromatic amines or heterocyclic amines, such as aniline, N-methylbenzylamine, pyridine, morpholine, piperazine, and derivatives thereof, (3) alkanolamines, such as monoethanolamine, N-methylethanolamine, diethanolamine, triethanolamine, isopropanolamine, diisopropanolamine, triisopropanolamine, dibutylethanolamine, butyldiethanolamine, octyldiethanolamine, and lauryldiethanolamine, (4) arylamines, such as N-methylbenzylamine, (5) polyoxyalkylene alkylaminoethers, such as polyoxyethylene laurylaminoether and polyoxyethylene sterylaminoether, and (6) ammonia.

When a compound having an alkylene oxide group added thereto is used, an oxyalkyene group with 2 to 4 carbon atoms is preferable. Specific examples of an alkylene oxide include ethylene oxide, propylene oxide, and butylene oxide. The number of moles of the alkylene oxide added per mole of phosphoric acid is preferably 1 to 50 moles, more preferably 1 to 30 mol, and still more preferably 1 to 10 mol. The number of moles of the alkylene oxide added represents the number of moles of the alkylene oxide per mole of phosphoric acid in charged raw materials.

Among them, the organic phosphate ester compound (C) is preferably a phosphate ester salt having an alkyl group with 8 to 22 carbon atoms in the molecule, or a phosphate ester salt having a polyoxyalkylene group composed of an oxyalkylene group with 2 to 4 carbon atoms and an alkyl group with 8 to 22 carbon atoms in the molecule. Such a compound is used, so that the effects of the present invention can be further improved.

Specific examples of the organic phosphate ester compound (C) include a dibutylethanolamine salt of a phosphate ester of polyoxyethylene (number of moles of the alkylene oxide added is 5 (hereinafter, n=5)) isotridecyl ether, a triethylamine salt of a phosphate ester of polyoxyethylene (n=25) isooctadecvl ether, a butyl monoethanolamine salt of a phosphate ester of polyoxypropylene (n=10) isooctyl ether, a dibutylethanolamine salt of an isotridecyl phosphate ester, a potassium salt of a phosphate ester of polyoxyethylene (n=5) isotridecyl ether, a sodium salt of an isooctadecyl phosphate ester, a dibutylethanolamnnle salt of a tridecyl phosphate ester, and a phosphate ester of polyoxyethylene (n=5) isotridecyl ether.

As the organic phosphate ester compound (C), one organic phosphate ester compound may be used alone, or two or more organic phosphate ester compounds may be used in combination.

If the sum of the content ratios of the smoothing agent (A), the unsaturated fatty acid metal salt (B), and the organic phosphate ester compound (C) in the treatment agent is taken as 100 parts by mass, the content ratio of the unsaturated fatty acid metal salt (B) in the treatment agent is preferably 0.1 to 10 parts by mass. The content ratio is defined in such a range, so that the effects of the present invention can be further improved.

If the sum of the content ratios of the smoothing agent (A), the unsaturated fatty acid metal salt (B), and the organic phosphate ester compound (C) in the treatment agent is taken as 100 parts by mass, the content ratio of the smoothing agent (A), the content ratio of the unsaturated fatty acid metal salt (B), and the content ratio of the organic phosphate ester compound (C) in the treatment agent are preferably 80 to 99.8 parts by mass, 0.1 to 10 parts by mass, and 0.1 to 10 parts by mass, respectively. The content ratios are defined in such ranges, so that the effects of the present invention can be further improved.

The treatment agent of the present embodiment may further contain a higher alcohol (D). When the treatment agent contains the higher alcohol (D), the stability of the treatment agent can be further improved.

The higher alcohol is a monohydric aliphatic alcohol having a hydrocarbon group with many carbon atoms. The number of carbon atoms in the higher alcohol is preferably 6 or more, more preferably 8 to 24, and still more preferably 12 to 24. The higher alcohol is not particularly limited in terms of the presence or absence of an unsaturated bond, and may be an alcohol having a linear or branched hydrocarbon group, or an alcohol having a cyclo ring. In the case of an alcohol having a branched hydrocarbon group, the branching position is not particularly limited. For example, the hydrocarbon group may have a carbon chain branched at an α-position or a carbon chain branched at β-position. The alcohol may be a primary alcohol or a secondary alcohol.

Among them, a Guerbet alcohol, that is, a monohydric aliphatic alcohol having a branched chain at a β-position of an alkyl chain is preferable, a Guerbet alcohol with 6 to 24 carbon atoms is more preferable, and a Guerbet alcohol with 12 to 24 carbon atoms is still more preferable.

Specific examples of the Guerbet alcohol include 2-ethyl-1-propanol, 2-ethyl-1-butanol, 2-ethyl-1-hexanol, 2-ethyl-1-octanol, 2-ethyl-decanol, 2-butyl-1-hexanol, 2-butyl-1-octanol, 2-butyl-1-decanol, 2-hexyl-1-octanol, 2-hexyl-1-decanol, 2-octyl-1-decanol, 2-octyl-1-dodecanol, 2-hexyl-1-octanol, 2-hexyl-1-dodecanol, 2-(1,3,3-trimethylbutyl)-5,7, 7-trimethyl-1-octanol, 2-(4-methylhexyl)-8-methyl-1-decanol, and 2-(1,5-dimethylhexyl)-5,9-dimethyl-1-decanol.

Specific examples of higher alcohols other than the above ones include stearyl alcohol and 2-dodecanol.

As the higher alcohol (D), one higher alcohol may be used alone, or two or more higher alcohols may be used in appropriate combination.

If the sum of the content ratios of the smoothing agent (A), the unsaturated fatty acid metal salt (B), and the higher alcohol (D) in the treatment agent is taken as 100 parts by mass, the content ratio of the unsaturated fatty acid metal salt (B) in the treatment agent is preferably 0.1 to 10 parts by mass. The content ratio is defined in such a range, so that the effects of the present invention can be further improved.

If the sum of the content ratios of the smoothing agent (A), the unsaturated fatty acid metal salt (B), and the higher alcohol (D) in the treatment agent is taken as 100 parts by mass, the content ratio of the smoothing agent (A), the content ratio of the unsaturated fatty acid metal salt (B), and the content ratio of the higher alcohol (D) in the treatment agent are 85 to 99.8 parts by mass, 0.1 to 10 parts by mass, and 0.1 to 15 parts by mass, respectively. The content ratios are defined in such ranges, so that the effects of the present invention can be further improved.

If the sum of the content ratios of the smoothing agent (A), the unsaturated fatty acid metal salt (B), the organic phosphate ester compound (C), and the higher alcohol (D) in the treatment agent is taken as 100 parts by mass, the content ratio of the unsaturated fatty acid metal salt (B) in the treatment agent is preferably 0.1 to 10 parts by mass. The content ratio is defined in such a range, so that the effects of the present invention can be further improved.

If the sum of the content ratios of the smoothing agent (A), the unsaturated fatty acid metal salt (B), the organic phosphate ester compound (C), and the higher alcohol (D) in the treatment agent is taken as 100 parts by mass, the content ratio of the smoothing agent (A), the content ratio of the unsaturated fatty acid metal salt (B), the content ratio of the organic phosphate ester compound (C), and the content ratio of the higher alcohol (D) in the treatment agent are 65 to 99.7 parts by mass, 0.1 to 10 parts by mass, 0.1 to 10 parts by mass, and 0.1 to 15 parts by mass, respectively. The content ratios are defined in such ranges, so that the effects of the present invention are further improved.

Second Embodiment

Next, a second embodiment in which an elastic fiber according to the present invention is embodied will be described. The treatment agent of the first embodiment is adhered to an elastic fiber of the present embodiment. The amount of the treatment agent (not containing a solvent) of the first embodiment adhered to the elastic fiber is not particularly limited, but the treatment agent is preferably adhered in a proportion of 0.1% to 10% by mass from the viewpoint of further improving the effects of the present invention.

The elastic fiber is not particularly limited, and examples thereof include polyester elastic fibers, polyamide elastic fibers, polyolefin elastic fibers, and polyurethane elastic fibers. Among them, polyurethane elastic fibers are preferable. In such a case, the effects of the present invention can be further exhibited more highly.

The method for producing the elastic fiber of the present embodiment includes feeding the treatment agent of the first embodiment to the elastic fiber. As a method for feeding the treatment agent, a method of adhering the treatment agent to the elastic fiber in a step of spinning the elastic fiber by a neat feeding method without diluting the treatment agent is preferable. As the adhering method, for example, a known method such as a roller lubrication method, a guide lubrication method, or a spray lubrication method can be used. A lubrication roller is generally located between a spinneret and a winding traverse, and can also be applied to the production method of the present embodiment. Among them, it is preferable to adhere the treatment agent of the first embodiment to an elastic fiber, for example, a polyurethane elastic fiber by a lubrication roller located between stretching rollers because the effects are remarkably exhibited.

The method for producing the elastic fiber itself applied to the present embodiment is not particularly limited, and the elastic fiber can be produced by a known method. Examples of the method include a wet spinning method, a melt spinning method, and a dry spinning method. Among them, the dry spinning method is preferable from the viewpoint of excellent quality and production efficiency of the elastic fiber.

The operation and effects of the treatment agent and the elastic fiber of the embodiments will be described.

(1) The treatment agent of the embodiment contains at least one smoothing agent (A) selected from the group consisting of a mineral oil, a silicone oil, and an ester oil and an unsaturated fatty acid metal salt (B). Therefore, it is possible to improve the shape properties of an elastic fiber to which the treatment agent is applied, particularly the shape properties when the elastic fiber is wound into a cheese shape. In addition, it is possible to improve the stability when the treatment agent is stored, particularly stored for a long period of time. In addition, the smoothness and the cob webbing prevention property of an elastic fiber to which the treatment agent is applied can be improved.

The above embodiments may be modified as follows. The above-described embodiments and the following modifications can be implemented in combination with each other, as long as there is no technical contradiction.

The treatment agent of the above embodiment may further contain a component usually used in a treatment agent, such as a stabilizer, an antistatic agent, a binder, an antioxidant, and an ultraviolet absorber for maintaining the quality of the treatment agent, as long as the effects of the present invention are not impaired.

EXAMPLES

Examples will now be given below to describe the features and effects of the present invention more specifically, but the present invention is not limited to these examples. In the following description of working examples and comparative examples, "parts" means parts by mass, and "%" means % by mass.

Experimental Part 1 (Preparation of Elastic Fiber Treatment Agent)

Treatment agents used in examples and comparative examples were prepared by the following preparation method using the components shown in Table 1.

A treatment agent of Example 1 was prepared by well mixing 30 parts (%) of dimethyl silicone (A-1) and 59 parts (%) of a mineral oil (A-2) as smoothing agents, 5 parts (%) of a magnesium salt (B-1) of oleic acid (C18:1) as an unsaturated fatty acid salt, 3 parts (%) of a dibutylethanolamine salt (C-1) of a phosphate ester of polyoxyethylene (n=5) isotridecyl ether as an organic phosphate ester compound, and 3 parts (%) of 2-hexyl-1-decanol (D-1) as a higher alcohol so as to make them uniform.

In Examples 2 to 22 and Comparative Examples 1 to 3, a smoothing agent, an unsaturated fatty acid salt, an organic phosphate ester compound, and a higher alcohol were mixed in the same manner as in Example 1 in the proportions shown in Table 1 to prepare treatment agents.

The types of the components, i.e., smoothing agent (A), unsaturated fatty acid salt (B), organic phosphate ester compound (C), and higher alcohol (D) in each of the treatment agents, and the content ratios of the respective components if the sum of the content ratios of the respective components is 100% are shown in the "smoothing agent (A)," "unsaturated fatty acid salt (B)," "organic phosphate ester compound(C)," and "higher alcohol (D)" columns in Table 1, respectively.

TABLE 1

| | Smoothing agent (A) | | Unsaturated fatty acid metal salt (B) | | Organic phosphate ester compound (C) | | Higher alcohol (D) | | Evaluation | | | |
|---|---|---|---|---|---|---|---|---|---|---|---|---|
| Section | Symbol | Parts by mass | Symbol | Parts by mass | Symbol | Parts by mass | Symbol | Parts by mass | Stability | Shape | Smoothness | Cob webbing prevention property |
| Example 1 | A-1 | 30 | B-1 | 5 | C-1 | 3 | D-1 | 3 | ◎ | ◎ | ◎ | ◎ |
| | A-2 | 59 | | | | | | | | | | |
| Example 2 | A-1 | 10 | B-1 | 6.1 | C-1 | 1.8 | D-1 | 8 | ◎ | ◎ | ◎ | ◎ |
| | A-3 | 74.1 | | | | | | | | | | |
| Example 3 | A-1 | 30 | B-1 | 3 | C-6 | 3 | D-1 | 5 | ◎ | ◎ | ◎ | ◎ |
| | A-2 | 50 | | | | | | | | | | |
| | A-4 | 9 | | | | | | | | | | |
| Example 4 | A-1 | 70 | B-2 | 2.4 | C-4 | 0.5 | D-2 | 1 | ◎ | ◎ | ◎ | ◎ |
| | A-2 | 26.1 | | | | | | | | | | |
| Example 5 | A-1 | 30 | B-3 | 0.6 | C-2 | 2 | D-1 | 0.5 | ◎ | ◎ | ◎ | ◎ |
| | A-2 | 66.9 | | | | | | | | | | |
| Example 6 | A-1 | 30 | B-1 | 0.3 | C-2 | 3 | D-1 | 3 | ◎ | ◎ | ◎ | ◎ |
| | A-2 | 63.7 | | | | | | | | | | |
| Example 7 | A-1 | 40 | B-4 | 3.4 | C-3 | 3.1 | D-1 | 2 | ◎ | ◎ | ◎ | ◎ |
| | A-2 | 51.5 | | | | | | | | | | |
| Example 8 | A-1 | 38 | B-1 | 8 | C-1 | 9 | D-2 | 5 | ◎ | ◎ | ◎ | ◎ |
| | A-2 | 40 | | | | | | | | | | |
| Example 9 | A-1 | 40 | B-1 | 5 | C-1 | 3 | D-1 | 12 | ◎ | ◎ | ◎ | ◎ |
| | A-2 | 40 | | | | | | | | | | |
| Example 10 | A-1 | 30 | B-5 | 2.3 | C-1 | 3 | D-1 | 5 | ◎ | ◎ | ◎ | ◎ |
| | A-2 | 59.7 | | | | | | | | | | |
| Example 11 | A-1 | 10 | B-1 | 4.2 | C-5 | 1 | D-1 | 2.3 | ◎ | ◎ | ◎ | ◎ |
| | A-2 | 82.5 | | | | | | | | | | |
| Example 12 | A-1 | 60 | B-6 | 2.3 | C-1 | 3 | D-1 | 5 | ◎ | ◎ | ◎ | ◎ |
| | A-2 | 29.7 | | | | | | | | | | |
| Example 13 | A-1 | 30 | B-1 | 3 | C-6 | 3 | D-1 | 5 | ◎ | ◎ | ◎ | ◎ |
| | A-2 | 59 | | | | | | | | | | |
| Example 14 | A-1 | 30 | B-1 | 3 | C-7 | 3 | D-1 | 5 | ◎ | ◎ | ◎ | ◎ |
| | A-2 | 59 | | | | | | | | | | |
| Example 15 | A-1 | 30 | B-7 | 5 | C-1 | 3 | D-1 | 3 | ◎ | ◎ | ○ | ◎ |
| | A-2 | 59 | | | | | | | | | | |
| Example 16 | A-1 | 30 | B-8 | 5 | C-1 | 3 | D-1 | 3 | ◎ | ◎ | ○ | ◎ |
| | A-2 | 59 | | | | | | | | | | |
| Example 17 | A-1 | 30 | B-1 | 5 | C-8 | 3 | D-1 | 3 | ◎ | ◎ | ◎ | ○ |
| | A-2 | 59 | | | | | | | | | | |
| Example 18 | A-1 | 33 | B-1 | 5 | C-1 | 3 | — | — | ○ | ◎ | ◎ | ◎ |
| | A-2 | 59 | | | | | | | | | | |
| Example 19 | A-1 | 33 | B-1 | 3 | — | — | D-1 | 5 | ◎ | ○ | ◎ | ○ |
| | A-2 | 59 | | | | | | | | | | |
| Example 20 | A-1 | 40 | B-8 | 3 | C-8 | 3 | — | — | ○ | ◎ | ○ | ○ |
| | A-2 | 54 | | | | | | | | | | |
| Example 21 | A-1 | 40 | B-1 | 5 | — | — | — | — | ○ | ○ | ◎ | ○ |
| | A-2 | 55 | | | | | | | | | | |
| Example 22 | A-1 | 40 | B-7 | 5 | — | — | — | — | ○ | ○ | ○ | ○ |
| | A-2 | 55 | | | | | | | | | | |
| Comparative Example 1 | A-1 | 45 | rb-1 | 3 | C-2 | 3 | D-1 | 4 | X | X | ○ | X |
| | A-2 | 45 | | | | | | | | | | |
| Comparative Example 2 | A-1 | 45 | rb-1 | 5 | — | — | — | — | X | X | ○ | X |
| | A-2 | 50 | | | | | | | | | | |
| Comparative Example 3 | A-1 | 45 | rb-2 | 5 | — | — | — | — | ○ | X | X | ○ |
| | A-2 | 50 | | | | | | | | | | |

Details of A-1 to A-4, B-1 to B-8, rb-1, rb-2, C-1 to C-8, D-1, and D-2 indicated in Table 1 are as follows.

Smoothing Agent (A)

A-1: dimethyl silicone (10 cst ($mm^2/s$), 25° C.)
A-2: mineral oil (having a viscosity of 60 seconds as measured with a Redwood viscometer at 40° C.)
A-3: mineral oil (having a viscosity of 100 seconds as measured with a Redwood viscometer at 40° C.)
A-4: isotridecyl stearate Unsaturated Fatty Acid Metal Aalt (B)

B-1: magnesium salt of oleic acid (C18:1)
B-2: calcium salt of oleic acid (C18:1)
B-3: magnesium salt of linoleic acid (C18:2)
B-4: magnesium salt of palmitoleic acid (C16:1)
B-5: magnesium salt of myristoleic acid (C14:1)
B-6: magnesium salt of erucic acid (C22:1)
B-7: sodium salt of oleic acid (C18:1)
B-8: potassium salt of paimitoleic acid (C16:1)
rb-1: magnesium salt of stearic acid (C18)
rb-2: oleic acid (C18:1)

Organic Phosphate Ester Compound (C)

C-1: dibutylethanolannine salt of phosphate ester of polyoxyethylene (n=5) isotridecyl ether
C-2: triethylamine salt of phosphate ester of polyoxyethylene (n=25) isooctadecyl ether
C-3: butyl monoethanolamine salt of phosphate ester of polyoxypropylene (n=10) isooctyl ether
C-4: dibutylethanolannine salt of isotridecyl phosphate ester
C-5: potassium salt of phosphate ester of polyoxyethylene (n=5) isotridecyl ether
C-6: sodium salt of isooctadecyl phosphate ester
C-7: dibutylethanolamine salt of tridecyl phosphate ester
C-8: phosphate ester of polyoxyethylene (n=5) isotridecyl ether Higher Alcohol (D)

D-1: 2-hexyl-1 decanol
D-2: 2-(1,3,3-trimethylbutyl)-5,7,7-trimethyl-1-octanol

Experimental Part 2 (Production of Elastic Fiber)

A prepolymer obtained from polytetramethylene having a molecular weight of 1,000 and diphenylmethane diisocyanate was subjected to a chain extension reaction with ethylenediamine in a dimethylformamide solution to obtain a spinning dope having a concentration of 30%. This spinning dope was dry-spun from a spinneret in a heated gas stream. The treatment agent prepared in Experimental Part 1 was neat-fed to the dry-spun polyurethane elastic fiber by a roller lubrication method. Subsequently, the polyurethane elastic fiber to which the treatment agent had been applied was wound into a package to obtain a 20 denier (monofilament) treated polyurethane elastic fiber. The amount of the treatment agent adhered was adjusted to 5% by adjusting the rotation speed of the lubrication roller.

The thus-obtained package of dry-spun polyurethane elastic fiber to which the treatment agent was fed with the roller was used to evaluate the shape properties, smoothness, and cob webbing prevention property of the elastic fiber. In addition, the treatment agent prepared in Experimental Part 1 was used to evaluate the stability.

Experimental Part 3 (Evaluation of Elastic Fiber and the Like)

Evaluation of Stability

The treatment agent prepared in Experimental Part 1 was allowed to stand at 25° C. for 3 months, and the stability was evaluated according to the following criteria. The results are shown in the "stability" column in Table 1.

◎ (good): There was no precipitation or separation, and a uniform state as in the preparation was maintained.
○ (fair): There was very slight precipitation, but it was restored to a uniform state as in the preparation by stirring.
× (poor): There was precipitation or separation, and it was not restored to a uniform state by stirring.

Evaluation of Shape Properties

The treatment agent prepared in Experimental Part 1 was adhered, in an amount of 5.0%, to the 20 denier (monofilament) dry-spun polyurethane elastic fiber by a roller lubrication method. The elastic fiber (500 g) was wound around a cylindrical paper tube having a length of 57 mm at a winding speed of 550 m/min via a traverse guide giving a winding width of 42 mm using a winding machine of a surface drive to obtain a package of polyurethane elastic fiber.

A maximum value (Wmax) and a minimum width (Wmin) of the winding width of the fiber package (500 g winding) were measured, and a bulge was obtained from a difference (Wmax−Wmin) between the values and evaluated according to the following criteria. The results are shown in the "shape" column in Table 1.

◎ (good): The bulge is less than 3 mm.
○ (fair): The bulge is 3 mm or more and less than 6 mm.
× (poor): The bulge is 6 mm or more.

Evaluation of Smoothness

A friction measuring meter (SAMPLE FRICTION UNIT MODEL TB-1 manufactured by EIKO SOKKI. Inc) was used, a chromium-plated satin pin having a diameter of 1 cm and a surface roughness of 2 S was disposed between two free rollers, and a contact angle of the polyurethane elastic fiber drawn out from the package (500 g winding) described above with respect to the chromium-plated satin pin was set to 90 degrees.

Under the conditions of 25° C. and 60% RH, an initial tension (T1) of 5 g was applied on an entrance side, and a secondary tension (T2) on an exit side when the yarn was made to travel at a speed of 100 m/min was measured every 0.1 second for 1 minute. A friction coefficient was obtained from the following formula and evaluated according to the following criteria. The results are shown in the "smoothness" column in Table 1.

$$\text{Friction Coefficient}=(2/3.14)\times\ln(T_2/T_1) \quad \text{[Mathematical Formula 1]}$$

◎ (good): The friction coefficient was 0.15 or more and less than 0.22.
○ (fair): The friction coefficient was 0.22 or more and less than 0.30.
x (poor): The friction coefficient was 0.30 or more.

Evaluation of Cob Webbing Prevention Property

The number of times of yarn breakage due to the cob webbing of the obtained dry-spun polyurethane elastic fiber package (500 g winding) immediately after spinning, when the package was wound for 1,000 m at a delivery speed of 20 m/min and a winding speed of 40 m/min, was evaluated according to the following criteria. The results are shown in the "cob webbing prevention property" column in Table 1.

◎ (good): The number of times of yarn breakage due to cob webbing is 0.

○ (fair): The number of times of yarn breakage due to cob webbing is 1 or more and less than 3.

× (poor): The number of times of yam breakage due to cob webbing is 3 or more.

As is apparent from the evaluation results of the respective examples relative to the respective comparative examples in Table 1, the treatment agent of the present invention can improve the shape properties of an elastic fiber to which the treatment agent is applied. In addition, the stability of the treatment agent, and the smoothness and cob webbing prevention property of the elastic fiber can be improved.

The present invention also encompasses the following embodiments.

Additional Embodiment 1

An elastic fiber treatment agent comprising a silicone oil as a smoothing agent (A), an unsaturated fatty acid metal salt (B), and a higher alcohol (D), and optionally an organic phosphate ester compound (C), wherein an alcohol forming the higher alcohol (D) is a Guerbet alcohol.

Additional Embodiment 2

The elastic fiber treatment agent according to additional embodiment 1, further comprising at least one selected from the group consisting of a mineral oil and an ester oil, which are smoothing agents (A).

Additional Embodiment 3

The elastic fiber treatment agent according to additional embodiment 1 or 2, wherein the unsaturated fatty acid metal salt (B) is an unsaturated fatty acid alkaline earth metal salt.

Additional Embodiment 4

The elastic fiber treatment agent according to any one of additional embodiments 1 to 3, wherein the unsaturated fatty acid metal salt (B) has 12 to 24 carbon atoms.

Additional Embodiment 5

The elastic fiber treatment agent according to any one of additional embodiments 1 to 4, wherein the organic phosphate ester compound (C) is an organic phosphate ester salt.

Additional Embodiment 6

The elastic fiber treatment agent according to any one of additional embodiments 1 to 4, wherein if the sum of the content ratios of the smoothing agent (A), the unsaturated fatty acid metal salt (B), and the organic phosphate ester compound (C) in the elastic fiber treatment agent is taken as 100 parts by mass, the content ratio of the unsaturated fatty acid metal salt (B) in the elastic fiber treatment agent is 0.1 to 10 parts by mass.

Additional Embodiment 7

The elastic fiber treatment agent according to any one of additional embodiments 1 to 5, wherein if the sum of the content ratios of the smoothing agent (A), the unsaturated fatty acid metal salt (B), the organic phosphate ester compound (C), and the higher alcohol (D) in the elastic fiber treatment agent is taken as 100 parts by mass, the content ratio of the unsaturated fatty acid metal salt (B) in the elastic fiber treatment agent is 0.1 to 10 parts by mass.

Additional Embodiment 8

An elastic fiber to which the elastic fiber treatment agent according to any one of additional embodiments 1 to 7 is adhered.

The invention claimed is:

1. An elastic fiber treatment agent comprising a silicone oil as a smoothing agent (A), an unsaturated fatty acid metal salt (B) being an unsaturated fatty acid alkaline earth metal salt, and a higher alcohol (D), and optionally an organic phosphate ester compound (C), wherein an alcohol forming the higher alcohol (D) is a Guerbet alcohol, wherein the unsaturated fatty acid alkaline earth metal salt is a calcium salt or magnesium salt of oleic acid, linoleic acid, palmitoleic acid, myristoleic acid, or erucic acid.

2. The elastic fiber treatment agent according to claim 1, further comprising at least one selected from the group consisting of a mineral oil and an ester oil, which are smoothing agents (A).

3. The elastic fiber treatment agent according to claim 1, wherein the unsaturated fatty acid metal salt (B) has 12 to 24 carbon atoms.

4. The elastic fiber treatment agent according to claim 1, wherein the organic phosphate ester compound (C) is an organic phosphate ester salt.

5. The elastic fiber treatment agent according to claim 1, wherein if the sum of the content ratios of the smoothing agent (A), the unsaturated fatty acid metal salt (B), and the organic phosphate ester compound (C) in the elastic fiber treatment agent is taken as 100 parts by mass, the content ratio of the unsaturated fatty acid metal salt (B) in the elastic fiber treatment agent is 0.1 to 10 parts by mass.

6. The elastic fiber treatment agent according to claim 1, wherein if the sum of the content ratios of the smoothing agent (A), the unsaturated fatty acid metal salt (B), the organic phosphate ester compound (C), and the higher alcohol (D) in the elastic fiber treatment agent is taken as 100 parts by mass, the content ratio of the unsaturated fatty acid metal salt (B) in the elastic fiber treatment agent is 0.1 to 10 parts by mass.

7. An elastic fiber to which the elastic fiber treatment agent according to claim 1 is adhered.

* * * * *